US005702129A

United States Patent [19]

Harrington

[11] Patent Number: 5,702,129

[45] Date of Patent: Dec. 30, 1997

[54] RISER ASSEMBLY FOR UNDERGROUND PIPE CONNECTIONS

[75] Inventor: Donald Weber Harrington, Lynchburg, Va.

[73] Assignee: Donald Harrington, Lynchburg, Va.

[21] Appl. No.: 593,367

[22] Filed: Jan. 29, 1996

[51] Int. Cl.[6] ..... F16L 35/00; F16L 41/00

[52] U.S. Cl. ..... 285/45; 285/156; 285/169

[58] Field of Search ..... 285/45, 138, 133.1, 285/156, 169, 179

[56] References Cited

U.S. PATENT DOCUMENTS

| | | | |
|---|---|---|---|
| 2,916,308 | 12/1959 | Voldrich et al. | 285/45 |
| 4,085,950 | 4/1978 | Alfwitz | 285/45 |
| 4,932,257 | 6/1990 | Webb | 285/45 |
| 5,031,940 | 7/1991 | Stefanos | 285/45 |
| 5,052,224 | 10/1991 | Ford et al. | 285/138 |
| 5,054,523 | 10/1991 | Rink | 285/133.1 |
| 5,553,971 | 9/1996 | Osborne | 285/133.1 |

FOREIGN PATENT DOCUMENTS

| | | | |
|---|---|---|---|
| 651312 | 8/1990 | Australia | 285/138 |

OTHER PUBLICATIONS

"Rubberman Triple Seal Pipe Encasement" brochure, Hail Mary Rubber Co., Inc.

*Primary Examiner*—Eric K. Nicholson
*Attorney, Agent, or Firm*—Nixon & Vanderhye

[57] ABSTRACT

The riser assembly includes a riser for fluid connection between a main fitting and a lateral pipe at different elevations. The lateral pipe is connected to the riser pipe by a 90° bend having an elongated bell along its vertically extending portion for slidably receiving the upper end of the riser pipe. The vertical bell rests on a casing cap overlying a casing pipe concentric with, but spaced from, the riser pipe. The casing pipe terminates in a casing shoe resting on bedding material about the riser whereby loads are transferred to the casing pipe and casing shoe without loading the riser pipe.

14 Claims, 2 Drawing Sheets

RISER ASSEMBLY FOR UNDERGROUND PIPE CONNECTIONS

TECHNICAL FIELD

The present invention relates to a riser assembly for connecting underground pipes at different elevations and particularly relates to a riser assembly wherein earth and live loadings on a riser pipe interconnecting a main pipe and a lateral pipe are minimized or substantially eliminated.

BACKGROUND

Underground pipe connections often include a main pipeline or pipe having a main fitting and a riser coupled at its lower end to the main fitting and to an elbow at its upper end for connection to a lateral pipe at an elevation different than, typically above, the elevation of the main pipe. Such arrangements are common for sewer line connections where the lateral pipe extends from a house or building for connection to a more deeply embedded sewer pipe. Not infrequently, the fittings between the upper and lower ends of the riser and the respective lateral and main pipes break as a result of loadings placed on the pipe connections. For example, insufficient compacting of the bedding material about the riser and lateral pipe, traffic loadings above-ground on the pipe connections, as well as settlement of the bedding material about the riser can cause compressive stresses on the riser pipe, resulting in a break in the main fitting or in the fitting between the riser and the lateral pipe.

Efforts have been made to alleviate this problem, without success. For example, concrete has been poured about the riser pipe. This, however, has proven ineffective in removing loading from the riser pipe and avoiding breakage of the fitting at either or both ends of the riser pipe. Because of the great expense and labor involved in replacing broken fittings, there has developed a need for a riser system which will effectively preclude breakage of the fittings as a result of variable loadings placed on the riser over time.

According to the present invention, there is provided a novel and improved riser assembly wherein loads on the riser pipe and the sewer main fitting are minimized or substantially eliminated, notwithstanding applied loadings on the overlying ground, insufficient compaction of bedding material or settlement of the ground and bedding material about the riser assembly. To accomplish this, the present invention provides a casing pipe which surrounds the riser pipe and is slidable relative to the riser pipe. The casing pipe includes a casing cap at its upper end having an opening for slidably receiving the upper end of the riser pipe. The lower end of the riser pipe is secured to the main fitting of a main pipeline in a conventional manner, for example, in a gasketed bell. The upper end of the riser passes through the opening of the casing cap and is received within a vertical extending portion of an elbow or a 90° bend. The horizontal extending portion of the 90° bend has a gasketed bell for receiving the end of the lateral pipe in a conventional manner. The vertical portion of the 90° bend is elongated. Particularly, the depth of the bell on the vertical extending portion is elongated. Thus, the elongated bell slidably receives the upper end of the riser and which end terminates short of a stop formed on the interior of the bell. Consequently, the upper end of the riser and the elbow are slidable relative to one another. Additionally, a casing shoe is provided adjacent the lower end of the casing pipe. The casing shoe is preferably in the form of a laterally extending plate for transferring loading on the casing pipe onto surrounding ground and/or bedding material.

In use, it will be appreciated that with the foregoing construction, the lateral pipe, the elbow, casing cap, casing pipe and casing shoe are movable generally vertically relative to the riser pipe. In the event of settlement of the bedding material about the riser assembly, heavy overhead traffic or insufficient compaction with resulting downward movement of the lateral pipe, elbow, casing cap, casing pipe and casing shoe, the loading on those elements does not transfer to the riser pipe because of its slidable connection in the vertically extending elongated bell of the elbow. More particularly, the vertical live loads are transferred onto the casing pipe and hence onto the casing shoe and onto ground and/or bedding materials surrounding the main fitting. The riser therefore remains stationary and is not subjected to compression loadings on the riser, and hence the fittings, are minimized or substantially eliminated.

In a preferred embodiment according to the present invention, there is provided a riser assembly for underground pipe connections between a lateral pipe disposed above a generally horizontally extending main pipe and having a riser pipe extending generally vertically from a main fitting on the main pipe comprising a casing pipe for surrounding and axial movement relative to the riser pipe, a casing cap connected to the casing pipe at its upper end and an elbow having a horizontally extending portion for connection with the lateral pipe and a vertical extending portion for slidably receiving an upper end of the riser, the vertical portion engaging the casing cap, the casing pipe having a casing shoe adjacent a lower end thereof for distributing loading on the casing pipe, casing cap and elbow to surrounding bedding without loading the riser or main fitting.

In a further preferred embodiment according to the present invention, there is provided a riser assembly for underground pipe connections comprising a main pipeline having a main fitting with an upwardly extending bell, a riser pipe extending generally vertically from the main fitting and having a lower end thereof received in the bell, a casing member surrounding at least in part and movable relative to the riser pipe, a casing cap disposed on an upper end of the casing member and having an opening therethrough for receiving an upper end portion of the riser pipe, a lateral pipe, a generally 90° bend having a horizontal portion including a bell for receiving an end of the lateral pipe, the bend having a vertical portion including a bell engaging the casing cap, the vertical portion extending a greater distance than the horizontal portion and slidably receiving the upper end portion of the riser, the casing member having a casing element for distributing loading on the casing pipe, casing cap, and 90° bend to surrounding material without substantially loading the riser pipe.

Accordingly, it is a primary object of the present invention to provide a novel and improved riser assembly for underground pipes wherein live loading on the riser pipe and main pipe fitting are minimized and/or substantially eliminated.

BRIEF DESCRIPTION OF THE DRAWINGS

FIG. 3 is a vertical cross-sectional view of the riser assembly in

BEST MODE FOR CARRYING OUT THE INVENTION

Figure 1:
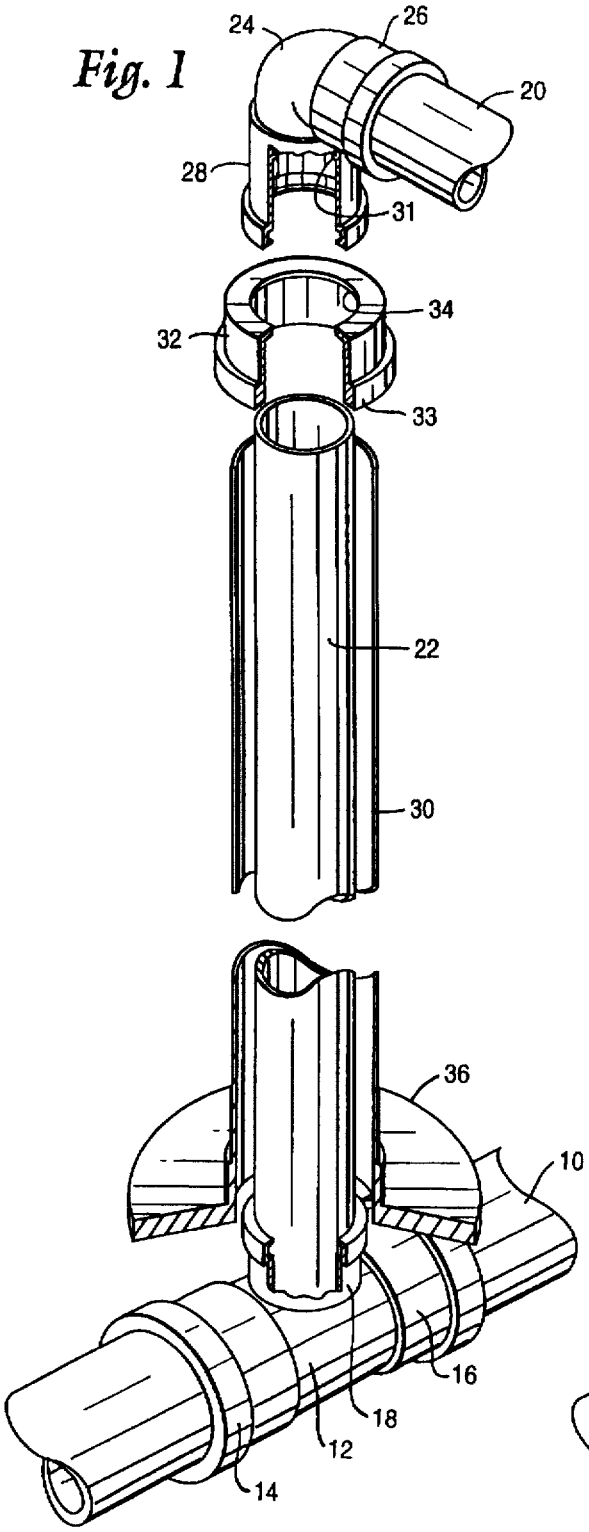
FIG. 1 is an exploded perspective view of a riser assembly according to the present invention with parts broken out and in cross-section.
Figure 2:
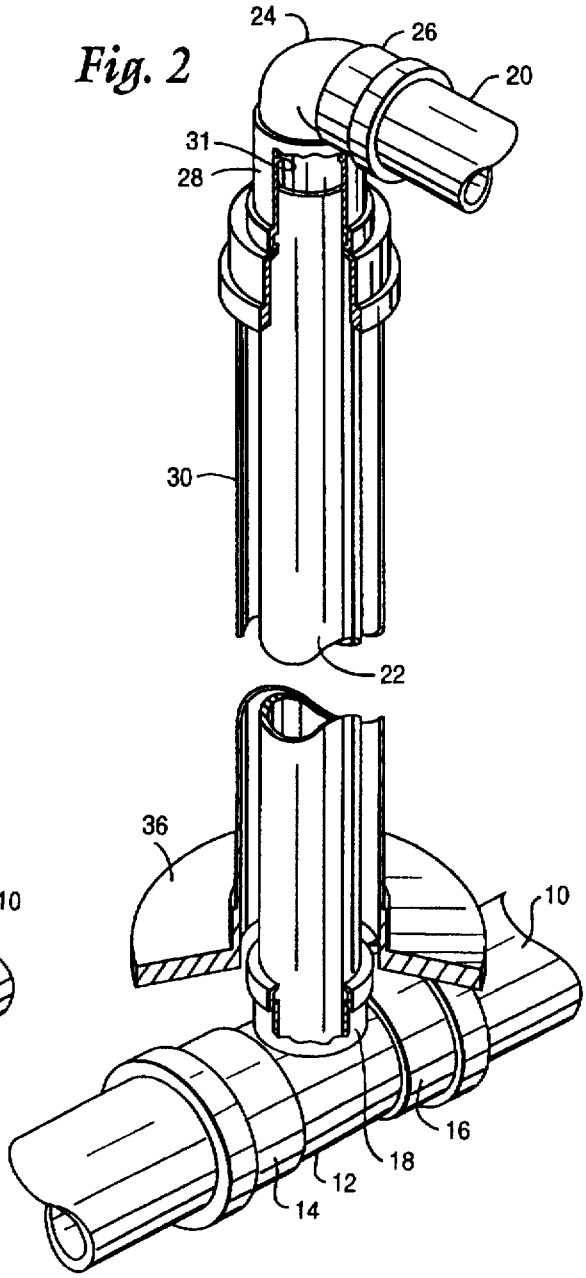
FIG. 2 is a view similar to FIG. 1 with the parts in assembly.
Figure 3:
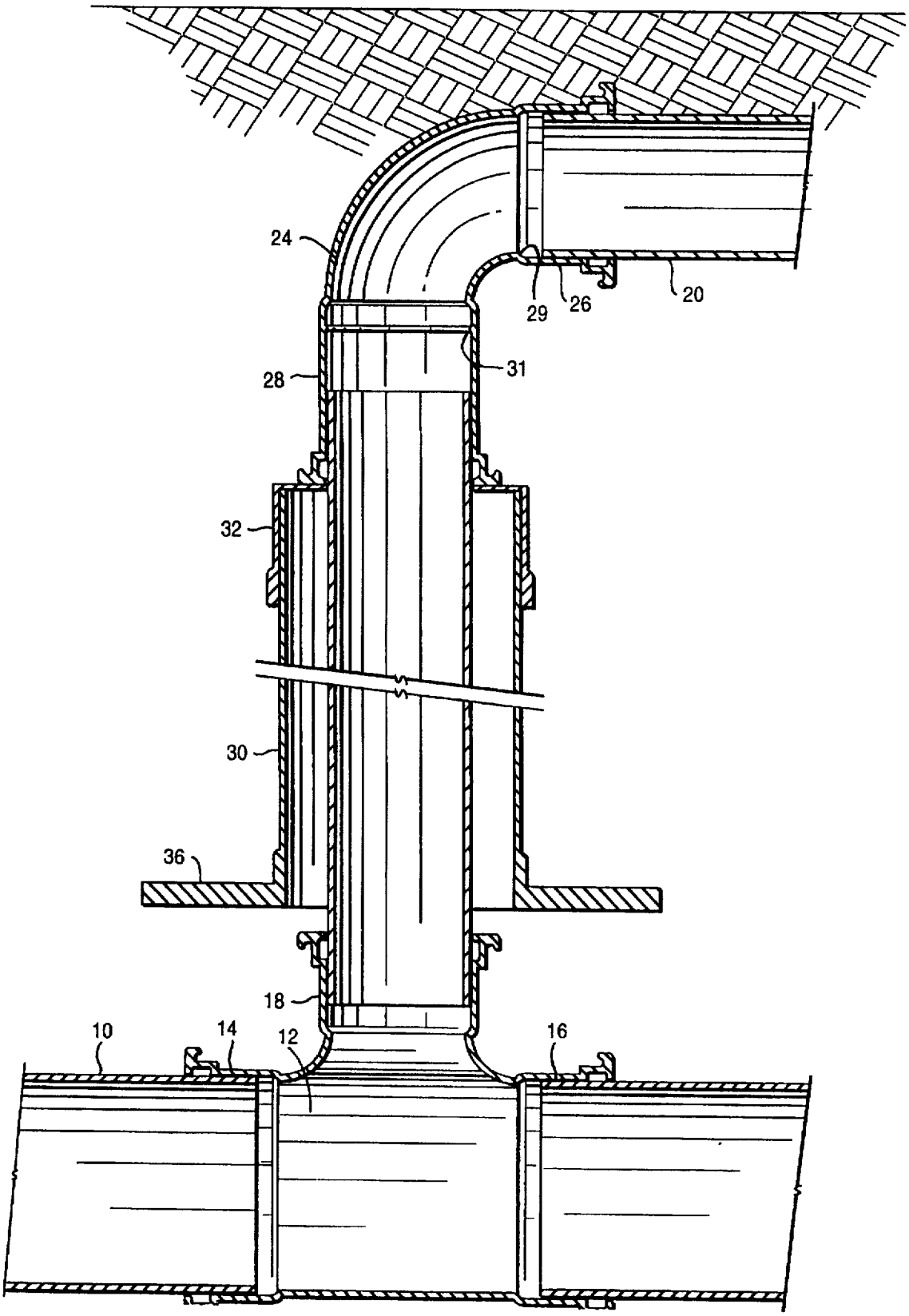

Referring now to the drawings, particularly to FIGS. 1 and 2, there is illustrated a main pipe 10 having a fitting 12, in this example, a T-fitting, having horizontally disposed bells 14 and 16 at opposite ends of the fitting and a lateral bell 18 upstanding from the fitting. The main pipe 10 may comprise a water or a sewer pipe with multiple connections and fittings at longitudinally spaced locations therealong to other pipes. For example, service laterals 20 may be connected to the main pipe for flow of sewage from a house or building to the main pipe. Generally speaking, the main pipe 10 and the lateral pipe 20 lie at different elevations and are connected one to the other, typically by a riser pipe 22 coupled through a 90° bend or elbow 24 to the lateral pipe. As explained previously, the substantially rigid connections between the elbow 24, riser pipe 22 and bell 18 on the main fitting 12 cause compressive loadings on the riser pipe which can break the riser pipe, the main fitting or the elbow.

In accordance with the present invention, all of the loadings, whether static or live, on the lateral pipe 20 and elbow 24 are transferred away from the riser pipe such that the riser pipe is not substantially loaded. Thus, the joint between the upper end of the riser pipe and the elbow and the lower end of the riser pipe and the main fitting likewise are not loaded and thus are prevented from rupturing. To accomplish this, the present invention provides a 90° bend or elbow 24 having horizontal and vertical portions 26 and 28, respectively, terminating in bells. The bell 28 of the vertical portion has a depth substantially greater than the length of the bell on the horizontal portion. As will be appreciated, bells 26 and 28 have internal stops 29 and 31, respectively. The joint between the horizontally extending bell 26 and the lateral pipe 20 is gasketed with the lateral pipe inserted into the bell. As will be appreciated from the ensuing description, the stop 31 of the vertical bell is spaced back from the upper end of the riser pipe when the riser pipe and the vertical bell are installed in the pipe system. As a consequence, the bend 24 and riser pipe 22 are vertically slidable relative to one another.

A casing member 30, preferably a cylindrical pipe, is provided concentric with, but spaced from, the riser pipe 22. The casing pipe 30 extends substantially the full length of the riser pipe. The upper end of casing pipe 30 terminates in a casing cap 32 which has an opening 34 sized to receive the upper end of the riser pipe 22. The casing cap 32 has an outer flange 33 which may receive and provide a stop for the upper end of the casing pipe. The casing pipe 30 has a casing shoe 36, preferably located at the lower end of casing pipe 30. The casing shoe preferably comprises a lateral projection for bearing against bedding material, for example, gravel, about the riser pipe and above the main fitting. In a particular form, the casing shoe 36 comprises a laterally projecting radial disk formed on the lower end of the casing pipe 30.

When the assembly is installed, the riser pipe 22 is coupled to the gasketed bell 18 of the main pipe 10. The casing pipe 30 with the casing shoe 36 and casing cap 32 are disposed about the riser pipe. The 90° bend 24 is connected to the lateral pipe 20 through the gasketed horizontal bell 26. The vertically extending end of the bend 24 is disposed such that the elongated bell slidably receives the upper end of the riser pipe 22. The casing pipe 30 is adjusted in elevation, for example, by disposing more or less bedding material below the casing shoe, such that the lower end of the vertical portion 28 of the bend 24 rests on the casing cap 32, with the riser pipe 22 terminating short of the stop 31 in the vertical bell portion 28 of the bend 24. The riser pipe 22 maintains the casing cap 32 and vertical portion 28 of the bend 24 in alignment one with the other but does not receive any substantial loading from the lateral pipe 20, elbow 24 or casing pipe 22 due to earth or live loads. For example, should settlement occur, the loading applied by the lateral pipe 20 to the elbow 24 will be transmitted to the casing pipe and to the casing shoe for transmission to the underlying bedding material. Consequently, any change in the loadings on the lateral pipe is transferred to the casing pipe through the bend and casing cap onto the surrounding bedding by the casing shoe. Any vertical displacement of the system is accommodated by the sliding fit between the upper end of the riser pipe and the elongated, vertically extending bell thereby relieving any additional loading from the elbow and main fitting.

It will be appreciated that the main pipeline, lateral and the riser pipe may be formed of any suitable material, such as PVC or iron. The fittings are preferably formed of ductile iron. The sizes of the pipes may vary with the particular system. For example, if a 4-inch riser pipe is used, a 6-inch casing pipe may be used. If a 6-inch riser pipe is used, an 8-inch casing pipe may be employed. Suffice to say, the casing pipe is free to move relative to the riser pipe and consequently greater or lesser spacing between the casing pipe and riser pipe may be provided.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A riser assembly for underground pipe connections between a lateral pipe disposed above a generally horizontally extending main pipe and having a riser pipe extending generally vertically from a main fitting on the main pipe comprising:

a casing pipe for surrounding and axial movement relative to the riser pipe;

a casing cap connected to the casing pipe at its upper end; and an elbow having a horizontally extending portion for connection with the lateral pipe and a vertical extending portion for slidably receiving an upper end of the riser, said vertical portion engaging said casing cap, said casing pipe having a casing shoe adjacent a lower end thereof for distributing loading on the casing pipe, casing cap and elbow to surrounding bedding without loading the riser or main fitting.

2. A riser assembly according to claim 1 wherein said casing shoe comprises a laterally extending member of enlarged lateral dimension relative to said casing pipe.

3. A riser assembly according to claim 2 wherein said member includes a plate extending radially outwardly of and substantially normal to said casing pipe.

4. A riser assembly according to claim I wherein said casing cap has an opening for receiving the upper end of the riser enabling the riser to be received in the vertical portion of the elbow.

5. A riser assembly according to claim 4 wherein said elbow seats on said casing cap about the riser, said elbow including an interior stop normally spaced from the upper end of the riser and enabling relative sliding movement of the riser and elbow in response to loadings on the system.

6. A riser assembly according to claim 1 wherein said elbow comprises a 90° bend, said vertical portion of said bend being longer than the horizontal portion of said bend.

7. A riser assembly according to claim 6 wherein said vertical portion of said bend includes an elongated bell.

8. A riser assembly for underground pipe connections comprising: a main pipeline having a main fitting with an upwardly extending bell;

a riser pipe extending generally vertically from said main fitting and having a lower end thereof received in said bell;

a casing member surrounding at least in part and movable relative to said riser pipe;

a casing cap disposed on an upper end of said casing member and having an opening therethrough for receiving an upper end portion of said riser pipe;

a lateral pipe;

a generally 90° bend having a horizontal portion including a bell for receiving an end of said lateral pipe;

said bend having a vertical portion including a bell engaging the casing cap, said vertical portion extending a greater distance than said horizontal portion and slidably receiving the upper end portion of the riser;

said casing member having a casing element for distributing loading on the casing pipe, casing cap, and 90° bend to surrounding material without substantially loading the riser pipe.

9. A riser assembly according to claim 8 wherein said casing element has an enlarged lateral dimension relative to said casing member.

10. A riser assembly according to claim 9 wherein said casing element includes a plate extending radially outwardly of and substantially normal to said casing member.

11. A riser assembly according to claim 8 wherein said bend seats on said casing cap about the riser, said bend including an interior stop spaced from the upper end of the riser to enable relative sliding movement of said riser and bend in response to loadings on the casing member, casing cap and elbow.

12. A riser assembly according to claim 8 wherein said bend includes a horizontal portion having a bell, the bell on said vertical portion having a length greater than the length of said bell on the horizontal portion.

13. A riser assembly according to claim 8 wherein said casing member comprises a cylindrical casing pipe surrounding said riser pipe and spaced laterally therefrom, said casing element including a lateral projection extending from said casing pipe.

14. A riser assembly according to claim 13 wherein said casing element includes a plate extending radially outwardly and substantially normal to said casing pipe.

* * * * *